US008826631B2

(12) United States Patent
Singer

(10) Patent No.: US 8,826,631 B2
(45) Date of Patent: Sep. 9, 2014

(54) DEVICE FOR FILLING PACKAGING RECEPTACLES WITH PHARMACEUTICAL PRODUCTS

(75) Inventor: Anton Singer, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 916 days.

(21) Appl. No.: 12/638,666

(22) Filed: Dec. 15, 2009

(65) Prior Publication Data

US 2010/0154354 A1 Jun. 24, 2010

(30) Foreign Application Priority Data

Dec. 22, 2008 (EP) ..... 08172610

(51) Int. Cl.

| | |
|---|---|
| ***B65B 5/00*** | (2006.01) |
| ***B65B 5/10*** | (2006.01) |
| ***B65B 39/00*** | (2006.01) |
| ***B65B 35/12*** | (2006.01) |
| *B65B 17/00* | (2006.01) |

(52) U.S. Cl.

CPC ..... *B65B 5/103* (2013.01); *B65B 39/007* (2013.01); *B65B 35/12* (2013.01)

USPC ..... 53/255; 53/167; 53/244; 53/247

(58) Field of Classification Search

CPC ..... B65B 1/30; B65B 39/007

USPC ..... 53/167, 244, 247, 255; 221/171, 172

See application file for complete search history.

(56) References Cited

U.S. PATENT DOCUMENTS

| | | | | |
|---|---|---|---|---|
| 2,595,226 | A | 5/1952 | Cookson | |
| 3,024,582 | A * | 3/1962 | Merrill | 53/167 |
| 3,768,227 | A * | 10/1973 | Grisell | 53/449 |
| 4,007,576 | A * | 2/1977 | Metz | 53/451 |
| 5,040,353 | A * | 8/1991 | Evans et al. | 53/54 |
| 5,329,749 | A * | 7/1994 | Yamamoto et al. | 53/525 |
| 5,369,940 | A * | 12/1994 | Soloman | 53/501 |
| 5,522,512 | A * | 6/1996 | Archer et al. | 209/580 |
| 5,737,902 | A | 4/1998 | Aylward | |
| 5,922,030 | A * | 7/1999 | Shank et al. | 222/56 |
| 5,960,609 | A * | 10/1999 | Abrams et al. | 53/428 |
| 5,966,910 | A * | 10/1999 | Ribani et al. | 53/560 |
| 6,050,064 | A * | 4/2000 | Yuyama et al. | 53/514 |
| 6,324,253 | B1 * | 11/2001 | Yuyama et al. | 378/57 |
| 6,497,083 | B1 * | 12/2002 | Garwood et al. | 53/244 |
| 6,985,798 | B2 * | 1/2006 | Crowder et al. | 700/240 |
| 7,337,596 | B2 * | 3/2008 | Barrett et al. | 53/531 |
| 7,455,166 | B2 | 11/2008 | Seiffert et al. | |
| 7,523,594 | B2 * | 4/2009 | Greenwald et al. | 53/255 |
| 7,530,213 | B2 * | 5/2009 | Barrett et al. | 53/531 |
| 7,721,508 | B2 * | 5/2010 | Yuyama et al. | 53/249 |

(Continued)

FOREIGN PATENT DOCUMENTS

| | | |
|---|---|---|
| EP | 1391386 A2 | 2/2004 |
| EP | 1698554 A1 | 9/2006 |

*Primary Examiner* — Gloria R Weeks

(74) *Attorney, Agent, or Firm* — Brinks Gilson & Lione

(57) ABSTRACT

The device for filling packaging receptacles with pharmaceutical products has a supply container for the pharmaceutical products and a feed device with at least one guide channel for conducting the pharmaceutical products by means of gravity from the supply container to the packaging receptacles. At least one high-voltage ionizer element supplied with alternating voltage is arranged in the area of the at least one guide channel.

10 Claims, 4 Drawing Sheets

(56) References Cited

U.S. PATENT DOCUMENTS

| | | | | |
|---|---|---|---|---|
| 7,770,355 | B2 * | 8/2010 | Inamura | 53/131.5 |
| 7,878,366 | B2 * | 2/2011 | Cicognani | 221/7 |
| 7,893,368 | B2 * | 2/2011 | Yamamoto et al. | 177/180 |
| 7,950,202 | B2 * | 5/2011 | Kodama et al. | 53/247 |
| 8,015,777 | B2 * | 9/2011 | Yagyu et al. | 53/447 |
| 8,061,109 | B2 * | 11/2011 | Freudelsperger | 53/52 |
| 8,096,100 | B2 * | 1/2012 | Greenwald et al. | 53/544 |
| 2005/0267628 | A1 * | 12/2005 | Crowder et al. | 700/240 |
| 2007/0044432 | A1 * | 3/2007 | Greenwald et al. | 53/246 |
| 2008/0134629 | A1 * | 6/2008 | Schmied et al. | 53/55 |

* cited by examiner

DEVICE FOR FILLING PACKAGING RECEPTACLES WITH PHARMACEUTICAL PRODUCTS

CROSS-REFERENCE TO RELATED APPLICATIONS

The present patent document claims the benefit of priority to European Patent Application No. EP 08172610.1, filed Dec. 22, 2008, and entitled "DEVICE FOR FILLING PACKAGING RECEPTACLES WITH PHARMACEUTICAL PRODUCTS," the entire contents of each of which are incorporated herein by reference.

FIELD OF THE INVENTION

The present invention relates to a device for filling packaging receptacles with pharmaceutical products.

BACKGROUND OF THE INVENTION

A device of this type is known from, for example, U.S. Pat. No. 5,737,902. The device described therein comprises a supply container for pharmaceutical products and a feed device with at least one feed channel for conducting the pharmaceutical products by means of gravity from the supply container into the packaging receptacles. The supply container is usually moved up and down to ensure that the pharmaceutical products are dispensed individually into the guide channel, in which the pharmaceutical products rest on top of each other and from which they are then dispensed downward sequentially into a drop chute. The drop chute in turn changes the direction of the tablets, which are at first oriented vertically, toward a horizontal position and conducts the tablets into the packaging receptacles, such as the pockets of a blister pack.

Instead of the sequential lowering of the tablets by means of laterally displaceable stacking trays as described in U.S. Pat. No. 5,737,902, the upper area of the guide channel can also comprise elaborate structures for singling out and conveying the tablets. Certain geometries of the guide channel are proposed for this purpose. These include a spiral geometry (see EP 1 391 386 A2) and a zigzag geometry with a three-dimensional component (see EP 1 698 554 A1).

In all these devices, plastic parts are preferably used to keep the cost down and to minimize the weight of the device. In some areas, it is possible for undesirable electrostatic charges to build up, which can interfere with the function of the packaging device.

For example, as a result of the up-and-down movement of the supply container, electrostatic charges are generated on the rubbing surfaces of the supply container and the feed tube, as a result of which an electrostatic field of considerable strength can develop, which can block the flow of the pharmaceutical products through the feed tube.

It is also possible for electrostatic charges to be generated by the sliding friction which occurs in the lower area of each drop chute at the point where the tablets change direction along their sliding path. These built-up electric charges can prevent the products from being deposited in the pockets.

BRIEF SUMMARY OF THE INVENTION

In accordance with the teachings of the present invention, a device is provided for filling packaging receptacles with pharmaceutical products in which, through an integral design, it is possible to prevent by simple means the malfunctions caused by the generation of electrostatic fields.

According to an aspect of the invention, the device for filling packaging receptacles with pharmaceutical products comprises a supply container for the pharmaceutical products and a feed device with at least one guide channel for conducting the pharmaceutical products by means of gravity from the supply container to the packaging receptacles. In the area of the at least one guide channel, at least one high-voltage ionizer element supplied with alternating voltage is provided.

With this design, it is possible in a simple manner to eliminate electrostatic charges as soon as they are formed and thus to ensure the reliable operation of the system without the need for additional external devices.

The electrostatic charges can be eliminated especially effectively by designing the at least one high-voltage ionizer element so that it at least partially surrounds the at least one guide channel.

An especially simple design, which can also be applied to a plurality of guide channels, consists in designing the at least one high-voltage ionizer element as a plate or strip.

In a preferred embodiment, the plate or strip extends horizontally, so that it can be easily integrated into the device.

A low-cost and light-weight design is obtained by fabricating the feed device at least partially of plastic.

The electrostatic charge can be eliminated even more effectively by arranging at least one grounding element in the area of the at least one guide channel.

To simplify the design, the grounding element is also preferably designed as a horizontally oriented plate or strip.

Each guide channel preferably comprises an upper segment, which is formed by a conveyor tube. In this case, a high-voltage ionizer element can be arranged in the area of the at least one conveyor tube to ensure the elimination of the electrostatic charges generated by the up-and-down movement of the supply container during the introduction of the tablets into the guide channel.

In such a case, it is advantageous for the high-voltage ionizer element to be arranged in an upper area of the conveyor tube and for the grounding element to be arranged below the high-voltage ionizer element.

In another advantageous embodiment, each guide channel comprises a lower segment, which is formed by a drop chute.

It is advantageous in this case for a high-voltage ionizer element to be arranged in the area of the drop chute, especially in the lower section of the drop chute with the horizontal component. This guarantees that the electrostatic charges generated during the deflection of the tablets within the drop chute are eliminated before the final deposition of the tablets into the packaging receptacles, as a result of which the packaging process can proceed without interruption.

In such a case it is advantageous for the grounding element to be arranged above the high-voltage ionizer element, because this has the effect of destroying the electrical charges on both sides. The reason for this is that the base plate, across which the packaging receptacles are drawn, also acts as a grounding element.

An arrangement of at least one high-voltage ionizer element in both the upper segment and the lower segment of the guide channel is especially preferred.

BRIEF DESCRIPTION OF THE DRAWINGS

Additional features and advantages of the present invention can be derived from the following description, which refers to the drawings.

DETAILED DESCRIPTION OF THE INVENTION

Figure 1:
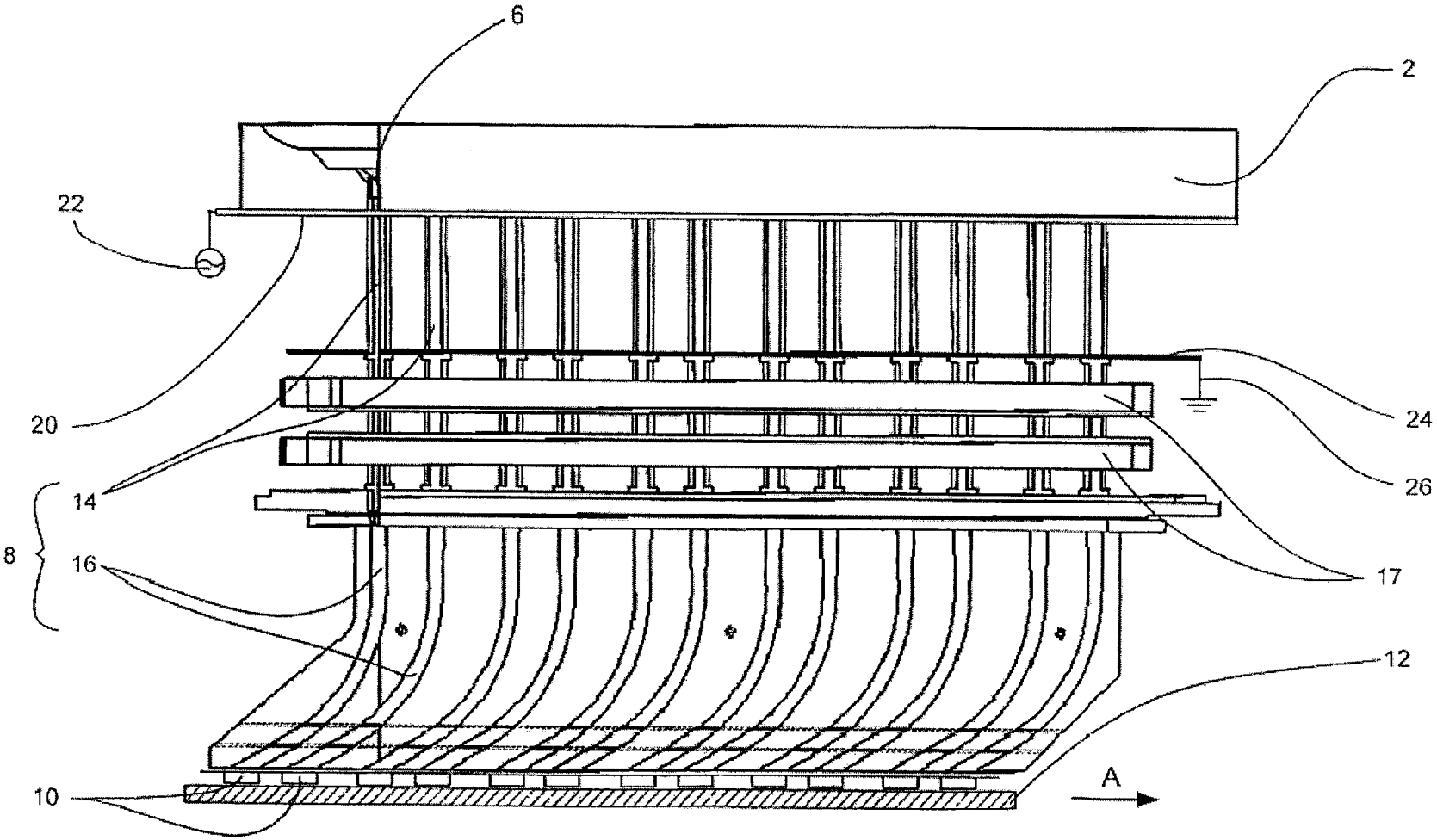
FIG. 1 is a cross-sectional schematic diagram of a first embodiment of the device for filling packaging receptacles with pharmaceutical products.

FIG. 1 shows a first embodiment of the device for filling packaging receptacles with pharmaceutical products such as tablets, dragées, capsules, etc.

The device comprises a supply container 2, in which the pharmaceutical products are stored temporarily before they are dispensed into the receptacles. In the embodiment shown here, the supply container 2 comprises one or more trough-shaped recesses, which are filled with the pharmaceutical products 4. In the bottom area of each of these recesses, there is an opening 6, which leads to a feed device with a guide channel 8, which is intended to conduct the pharmaceutical products 4 into the packaging receptacles 10. The packaging receptacles 10 are usually conducted at timed intervals in the direction of the arrow A across a base plate 12 located at the filling station by a transport device (not shown). It is also possible for the packaging receptacles 10 to move out of the plane of the drawing. In the standard case, the packaging receptacles 10 are designed as the pockets of a blister web, which is sealed with a cover film after the pockets have been filled with the pharmaceutical products 4. Individual blister packs are then stamped out from the web. Many other applications outside the pharmaceutical area, however, are also conceivable.

In the example being discussed here, each guide channel 8 comprises an upper segment 14 and a lower segment 16. In certain special embodiments, the guide channel 8 can also be of one-piece design and comprise merely a single segment.

Figure 2:
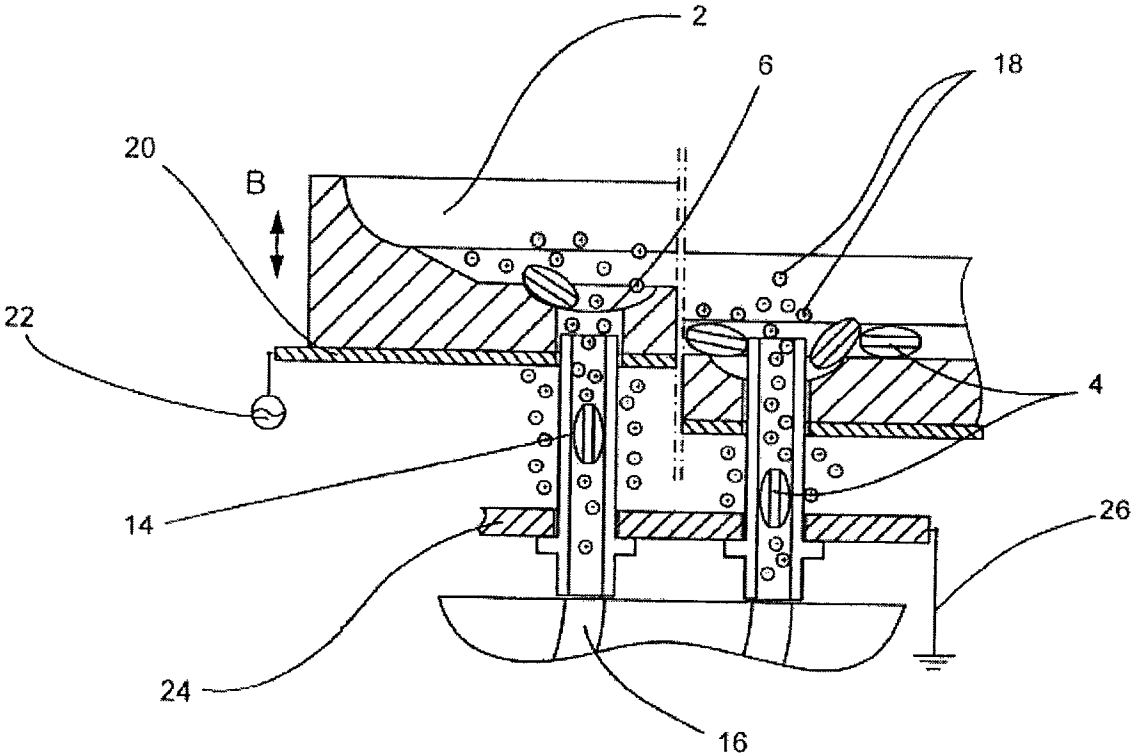
FIG. 2 is an enlarged view of part of the device of FIG. 1, namely, a part in the transition area between the supply container and the guide channel.

In this example, the upper segment 14 is designed as a conveyor tube, the upper part of which projects into an opening 6 in the supply container 2. The supply container 2, as shown by arrow B in FIG. 2, can be moved up and down. For the sake of clarity, the left part of the supply container 2 in FIG. 2 is shown in the "up" position, whereas the part of the supply container 2 on the right is shown in the "down" position. It can be seen here that, because of the up-and-down movement of the supply container 2, the conveyor tubes 14 project by different degrees into the supply container 2, which thus makes it possible for the pharmaceutical products 4 to be fed individually into the conveyor tubes 14. It is advantageous for a plurality of conveyor tubes 14 to be present in the manner of a matrix arrangement and for these tubes to be connected to the supply container 2 so that a plurality of pharmaceutical products 4 can be transported simultaneously to the packaging receptacles 10 and deposited in them.

Because the pharmaceutical products 4 are to be stacked temporarily in the conveyor tubes, slides 17 are provided, which can be pushed into the conveyor channel and pulled back out again. This ensures an intermediate buffering action at various levels and thus guarantees that never more than a single product 4 will be dispensed downward from each conveyor tube 14 at the preestablished times.

To minimize weight and to lower the cost of production, both the supply container 2 and the conveyor tubes 14 are made of plastic. During the up-and-down movement of the supply container 2, it is therefore possible for electrostatic charges 18 to be generated in the area of the opening 6. These charges can prevent the products 4 from entering the conveyor tubes 14. To exclude this possibility, the device comprises a high-voltage ionizer element 20 in the area of the conveyor tube 14, preferably in the upper area of this tube. This element extends preferably directly underneath the supply container 2 and across its entire width and preferably can be designed as an electrically conductive plate, such as a plate of metal or metalized plastic, preferably of high-grade steel, which comprises appropriate openings for the conveyor tubes 14. It is especially preferred to attach the plate directly to the base of the supply container 2. The high-voltage ionizer element 20 is preferably connected to a source of alternating voltage 22 by means of a flexible conducting wire which does not interfere with the movement of the supply container 2. The AC voltage source 22 supplies the high-voltage ionizer element 20 with alternating voltage preferably at a frequency of 50-60 Hz and in the range of 4-8 kV. The high-voltage terminal also contains appropriate high-voltage resistors for limiting the current and ensuring safety.

It is also possible to provide each individual conveyor tube 14 with a locally limited high-voltage ionizer element 20 or to provide some other geometric arrangement of the high-voltage ionizer elements 20. Various geometric designs are conceivable here.

To eliminate the electrostatic charges even more effectively, a grounding element 24, which is connected to the ground 26 by a flexible conducting wire and which preferably is also designed as a conductive metallic plate with pass-through openings for the conveyor tubes 14, is arranged underneath the high-voltage ionizer element 20. The grounding element can also have any one of various geometric designs.

Instead of the straight design shown here, the conveyor tubes 14 could have a spiral feed channel or a zigzag conveying channel with a three-dimensional component.

Figure 3:
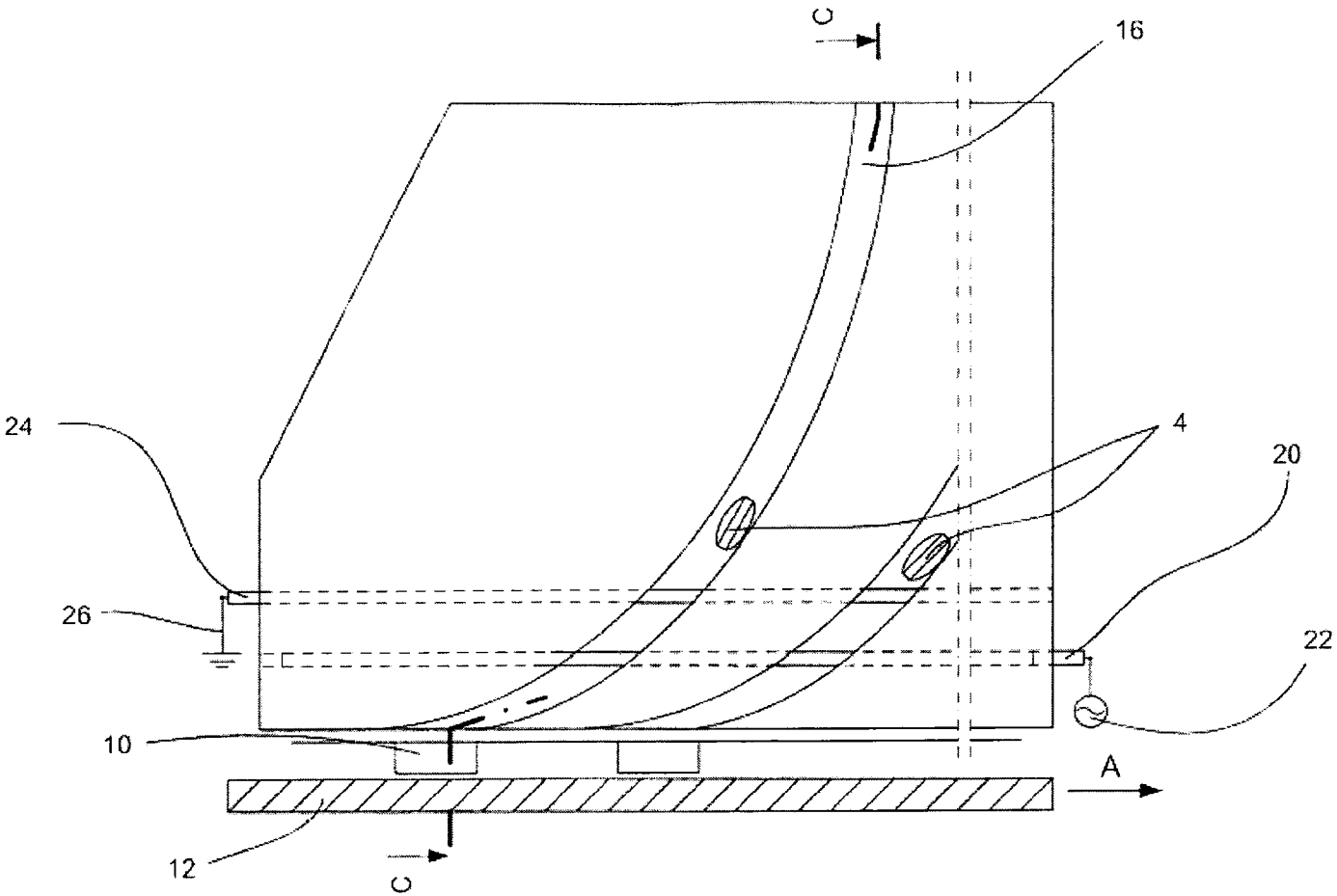
FIG. 3 is a cross-sectional schematic diagram of the lower area of a second embodiment of the device for filling packaging receptacles with pharmaceutical products.
Figure 4:
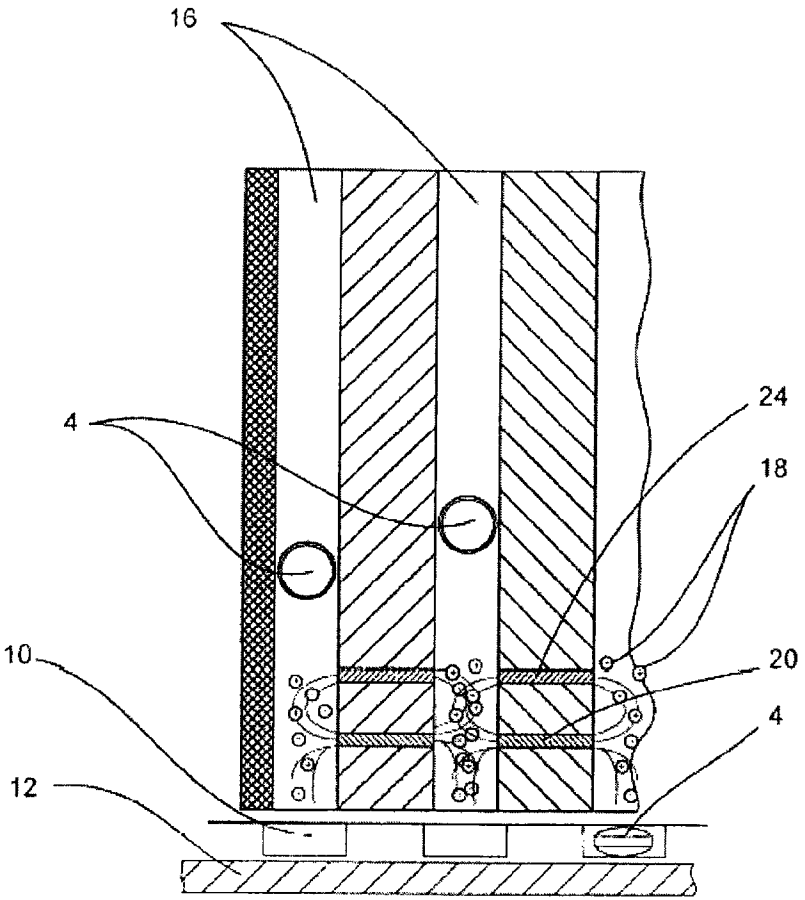
FIG. 4 is a cross-sectional schematic diagram of the lower area of the device of FIG. 3 along line C-C.

FIGS. 3 and 4 show a second alternative embodiment of the present invention. Here a high-voltage ionizer element 20 and a grounding element 24 are arranged in the lower segment 16 of each filling channel 8. This application is especially advantageous when the lower segment 16 is designed as a drop chute with a curved section in its lower area to turn the pharmaceutical products 4. Especially when the drop chutes 16, all of which are preferably integrated into a filling shoe, consist of plastic, the sliding friction of the pharmaceutical products 4 along the inside surfaces of the curved section of the drop chute 16 generates an electrostatic charge, which again can interfere with the filling of the packaging receptacles 10 with the pharmaceutical products 4. In this case, it is preferable for the high-voltage ionizer element 20 and the grounding element 24 to be designed as strips, wherein openings can be provided in the strip for the drop chutes 16. It is also possible to provide several strips. The geometry of the arrangement can take many possible forms. In this embodiment, however, it is advantageous for the high-voltage ionizer element 20 to be arranged in the lower area of the drop chutes 16 and for the grounding element 24 to be arranged above the high-voltage ionizer element 20. This ensures that the high-voltage ionizer element will act both upward and downward and thus eliminate the charges on both sides.

Of course, both of the alternative embodiments discussed above can be used jointly in the same device. In this way, it is possible to eliminate effectively the electrostatic charges at all critical points of the filling device in areas close to their place of origin.

The invention claimed is:

1. A device for filling packaging receptacles with tablets or capsules, comprising:

a supply container for the tablets or capsules;

a feed device with a plurality of guide channels for conducting the tablets or capsules by means of gravity from the supply container to the packaging receptacles;

at least one high-voltage ionizer element supplied with alternating voltage and arranged in an area of the plurality of guide channels, wherein the at least one high-voltage ionizer element is designed as a horizontally extending plate or strip and at least partially surrounds the plurality of guide channels; and at least one grounding element arranged in the area of the plurality of guide channels wherein the at least one grounding element is designed as a horizontally extending plate or strip and at least partially surrounds the plurality of guide channels;

the at least one high-voltage ionizer element and the at least one grounding element serving to eliminate electrostatic charges.

2. The device according to claim 1, wherein the feed device is made at least partially of plastic.

3. The device according to claim 1, wherein the at least one guide channel comprises an upper segment, which is formed by a conveyor tube, and the at least one high-voltage ionizer element is arranged in the area of the conveyor tube.

4. The device according to claim 3, wherein the at least one grounding element is arranged below the high-voltage ionizer element.

5. The device according to claim 1, wherein the at least one guide channel comprises a lower segment, which is formed by a drop chute, and the at least one high-voltage ionizer element is arranged in an area of the drop chute.

6. The device according to claim 5, wherein the drop chute comprises, in a lower area thereof, a section with a horizontal component for a proper filling of the packaging receptacles with the tablets or capsules, and wherein the at least one high-voltage ionizer element is arranged in an area of the section with the horizontal component.

7. The device according to claim 5, wherein the at least one grounding element is arranged above the high-voltage ionizer element.

8. The device according to claim 1, wherein the guide channel comprises an upper segment and a lower segment, and wherein at least one high-voltage ionizer element is arranged in an area of the upper segment and in an area of the lower segment.

9. The device according to claim 8, wherein at least one grounding element is arranged in an area of the upper segment and in an area of the lower segment.

10. The device according to claim 1, wherein the at least one grounding element is connected to ground.

* * * * *